US011046492B2

(12) United States Patent
Zhu

(10) Patent No.: US 11,046,492 B2
(45) Date of Patent: Jun. 29, 2021

(54) COTTON PACKAGING ROLL FILM AND PREPARATION METHOD THEREOF

(71) Applicant: ZHEJIANG YAJIA COTTON PICKER PARTS CO., LTD., Zhuji (CN)

(72) Inventor: Wuchuan Zhu, Zhuji (CN)

(73) Assignee: ZHEJIANG YAJIA COTTON PICKER PARTS CO., LTD.

( * ) Notice: Subject to any disclaimer, the term of this patent is extended or adjusted under 35 U.S.C. 154(b) by 0 days.

(21) Appl. No.: 16/584,947

(22) Filed: Sep. 27, 2019

(65) Prior Publication Data

US 2021/0070514 A1 Mar. 11, 2021

(51) Int. Cl.
*B65D 65/14* (2006.01)
*B65D 65/22* (2006.01)

(52) U.S. Cl.
CPC ..... *B65D 65/14* (2013.01); *B65D 65/22* (2013.01); *Y10T 428/1476* (2015.01)

(58) Field of Classification Search
CPC . A01F 25/13; A01F 2015/0745; B65D 65/14; B65D 65/22; Y10T 428/1476; Y10T 428/15
See application file for complete search history.

(56) References Cited

U.S. PATENT DOCUMENTS 10,264,732 B2 * 4/2019 Porter ..... A01F 15/071

FOREIGN PATENT DOCUMENTS

CN 107142033 B 3/2018

* cited by examiner

*Primary Examiner* — Alexander S Thomas

(57) ABSTRACT

A cotton packaging roll film comprising a roll film base material formed by a plurality of packaging sections that are connected end to end; the packaging section comprises an adhesive area and a non-adhesive area connected with the adhesive area; the adhesive area of a previous packaging section is connected to one end of the non-adhesive area of a later packaging section, wherein the said end of the non-adhesive area is a Z-shaped folded end; a detachable bonding structure is arranged between the two end surfaces of the recession of the folded end close to the middle portion of the adhesive area; a tearing line used for separation during packaging is arranged at the junction of the adhesive area of a previous packaging section and the non-adhesive area of a later packaging section.

10 Claims, 7 Drawing Sheets

COTTON PACKAGING ROLL FILM AND PREPARATION METHOD THEREOF

TECHNICAL FIELD OF THE INVENTION

The present invention relates to the technical field of packaging materials, and more particularly, to a cotton packaging roll film and a preparation method thereof.

BACKGROUND OF THE INVENTION

In traditional packaging operations, a roll film wound around a rolling drum is normally adopted to package items, wherein the end of the roll film must be bonded to a roll film layer underneath the roll film, thereby firmly wrapping the items. During the operation of a cotton picker, the cotton is finally wrapped and packaged by the roll film. Each packaging section of the roll film wound on the rolling drum comprises a non-adhesive roll film section and an adhesive roll film section. During packaging, the cotton is first wrapped by the non-adhesive roll film section for multiple turns, and then wrapped by the adhesive roll film section for multiple turns. The portions in contact with each other during the wrapping process of the adhesive roll film area are adhesive but detachable, thus finally enabling the tail end of the adhesive roll film section to be bonded to the adhesive roll film section located underneath.

A Chinese patent (patent no.: CN107142033B, granted and published on Mar. 16, 2018) discloses an automatic packaging roll film, wherein adhesive areas parallel to each other are transversely arranged on the same side of the roll film base material at intervals. A non-adhesive area is formed between every two adjacent adhesive areas, and each non-adhesive area and an adjacent adhesive area form a packaging section. Between adjacent packaging sections, the non-adhesive area of a previous packaging section and the adhesive area of a later packaging section are connected through a detachable adhesive tape. All the packaging sections are connected into a whole through detachable adhesive tapes, thereby forming a continuous and automatic packaging roll film.

In the automatic packaging roll film disclosed in the aforesaid patent, the non-adhesive area of a previous packaging area and the adhesive area of a later packaging area are connected through a detachable adhesive tape. The detachable adhesive tape comprises an adhesive, a double-sided adhesive base layer, a detachable layer and a strong adhesive layer. The double-sided adhesive base layer is folded into a U-shape. One end of the double-sided adhesive base layer is bonded to the non-adhesive area through an adhesive, and the other end of the double-sided adhesive base layer is bonded to the adhesive area through the strong adhesive layer. The detachable layer is located between the strong adhesive layer and the double-sided adhesive base layer, and is used for being detached during packaging. As both the two ends of the double-sided adhesive base layer are bonded through the adhesive, the amount of the adhesive consumed during the packaging process is large. However, the harmful ingredients in the adhesive can do great harm to the environment.

SUMMARY OF THE INVENTION

The purpose of the present invention is to solve the shortcomings in the prior art by providing a cotton packaging roll film. Through reducing the use amount of the adhesive, the environmental friendliness of the roll film can be greatly improved.

To achieve the above purpose, the present invention adopts the following technical solution:

A cotton packaging roll film comprising a roll film base material formed by a plurality of packaging sections that are connected end-to-end; the packaging section comprises an adhesive area and a non-adhesive area connected with the adhesive area; the adhesive area of a previous packaging section is connected to one end of the non-adhesive area of a later packaging section, wherein the said end of the non-adhesive area is a Z-shaped folded end; a detachable bonding structure is arranged between the two end surfaces of the recession of the folded end close to the middle portion of the adhesive area; the detachable bonding structure comprises a strong adhesive layer, a detachable layer and an adhesive layer; the strong adhesive layer and the adhesive layer are respectively located on the two end surfaces of the recession of the folded end close to the middle portion of the adhesive area; the detachable layer is located between the strong adhesive layer and the adhesive layer; a tearing line used for separation during packaging is arranged at the junction of the adhesive area of a previous packaging section and the non-adhesive area of a later packaging section.

Through adopting the aforesaid technical solution: the detachable bonding structure comprises a strong adhesive layer, a detachable layer and an adhesive layer; when the roll film is wound on a rolling drum, the detachable layer covers the adhesive layer, thereby preventing different layers of the roll film wound on the rolling drum from being bonded together; however, when the roll film is unrolled for packaging the cotton, the detachable layer can be peeled off and completed detached from the adhesive layer at the end of a cycle of the packaging section; the adhesive layer is used for being bonded to the adhesive area of the next layer for sealing at the end of the cycle of the packaging section; when the cycle of the packaging section is ended, the rolling drum stops rotating, and the packaged cotton can tear apart the tearing line under the action of the tension force generated by the rotating inertia, thereby separating the packaging sections during packaging; when the roll film body is torn along the tearing line, the portions of the roll film body at the two ends of the tearing line deform under the action of the tension force; due to the arrangement of the folded end of the adhesive area, a certain distance exists between the adhesive layer and the end edge of the adhesive area, thus preventing the adhesive area on the adhesive layer from easily deforming; in this way, the adhesive layer is kept flat, and the bonding effect of the adhesive layer isn't affected; moreover, when the tearing line is torn apart, a reversed tension exists between the adhesive area and the non-adhesive area, enabling the adhesive layer to be firmly boned to the adhesive area of the next layer under the action of the tension force; meanwhile, due to the tearing line adopted for separating the packaging sections, the use amount of the adhesive is reduced, improving the environmental friendliness of the roll film.

In another aspect of the present invention, on the two end surfaces of the recession of the folded end close to the middle portion of the adhesive area, the adhesive layer is located on the end surface close to the middle portion of the adhesive area.

Through adopting the aforesaid technical solution: on the two end surfaces of the recession of the folded end close to the middle portion of the adhesive area, the adhesive layer is located on the end surface close to the middle portion of the adhesive area; at this point, comparing with the situation that the adhesive layer is located on the end surface far away from the middle portion of the adhesive area, the distance between the adhesive layer and the end edge of the adhesive area is longer, further preventing the portions of the roll film body located on the two sides of the tearing line from affecting the adhesive layer due to the deformation caused by the tension force.

In another aspect of the present invention, a plurality of detachable bonding structures are arranged between the two end surfaces of the recession of the folded end close to the middle portion of the adhesive area, and the plurality of detachable bonding structures are distributed in the length direction or width direction of the roll film base material.

Through adopting the aforesaid technical solution: when a plurality of detachable bonding structures are distributed along the length direction of the roll film base material, after a cycle of the packaging section is ended, the adhesive layer is boned to the adhesive area of the next layer, thereby achieving a firm sealing; when a plurality of detachable bonding structures are distributed along the length direction of the roll film base material, along the direction of tension generated by the rotating inertia of the cotton packaged at the end of the packaging section cycle, the adhesive area between the adhesive layer and the detachable layer is small, allowing the detachable layer to be easily peeled off from the adhesive layer.

In another aspect of the present invention, the tearing line is located at the end portion of the non-adhesive area of a later packaging section close to the adhesive area of a previous packaging section. After the tearing line is torn apart during packaging, the portion of the non-adhesive area of a later packaging section that is located between the end portion and the tearing line is connected with the adhesive area of a previous packaging section.

Through adopting the aforesaid technical solution: when the packaging of a packaging section is completed, the portion of the non-adhesive area of a later packaging section that is located between the end portion and the tearing line is connected to the adhesive area of a previous packaging section; the non-adhesive area of a later packaging section that is connected to the adhesive area of a previous packaging section becomes warped, allowing the sealing position formed by the adhesive layer after packaging to be conveniently positioned; if the adhesive layer is not well bonded to the adhesive area of the next layer, the adhesive layer can be manually pressed and strengthened.

In another aspect of the present invention, the tearing line is located at the junction of the non-adhesive area of a later packaging section and the adhesive area of a previous packaging section.

Through adopting the aforesaid technical solution, after the packaging of a packaging section is completed, the end edge of the adhesive area can be bonded to the adhesive layer of the next layer.

In another aspect of the present invention, the tearing line is a broken line with easy-to-tear holes or a holt-melt joint.

In another aspect of the present invention, the tearing line is obliquely arranged, and the included angle formed between the tearing line and the width direction of the roll film base material is 1-5 degrees. The portions of the roll film base material located on the two sides of the tearing line have a thickness greater than that of the other portions of the roll film base material.

Through adopting the aforesaid technical solution: the tearing line is obliquely arranged, and the included angle formed between the tearing line and the width direction of the roll film base material is 1-5 degrees; at this point, the tearing line can be torn apart by the tension force generated by the rotating inertia of the cotton packaged when the packaging section cycle is ended; the portions of the roll film base material located on the two sides of the tearing line have a thickness greater than that of the other portions of the roll film base material, improving the strength of the portions of the roll film base material located on the two sides of the tearing line; when the roll film body is torn along the tearing line, the deformation of the portions of the roll film body at the two ends of the tearing line caused by the tension force can be reduced.

Another purpose of the present invention is to provide a method for preparing the cotton packaging roll film, which can improve the processing efficiency.

To achieve the above purpose, the present invention adopts the following technical solution:

A method for preparing the cotton packaging roll film, comprising the steps of:

S1: preparing a roll film base material: forming a plurality of adhesive areas and non-adhesive areas that are arranged at intervals on the roll film base material, wherein each adhesive area and an adjacent non-adhesive area form a packaging section;

S2: tearing off the release paper on one side of a double-sided adhesive tape, and bonding one end of the adhesive area of a previous packaging section close to the adhesive area of a later packaging section with the double-sided adhesive tape; coating a strong adhesive on the release paper on the other side of the double-sided adhesive tape, thereby forming a strong adhesive layer, wherein the adhesive on the double-sided adhesive tape forms an adhesive layer, and the release paper on the other side of the double-sided adhesive tape forms a detachable layer;

S3: folding the end portion of a previous packaging section to form a Z-shaped folded end, thereby allowing the double-sided adhesive tape to be located on an end surface of the recession of the folded end close to the middle portion of the adhesive area, and allowing the strong adhesive layer to be bonded to the other end surface of the recession of the folded end close to the middle portion of the adhesive area;

S4: forming a tearing line at the junction of the adhesive area of a previous packaging section and the non-adhesive area of a later packaging section.

Through adopting the aforesaid technical solution: through the arrangement of the double-sided adhesive tape, a detachable layer and an adhesive layer are formed; the raw material double-sided adhesive tapes can be directly purchased and conveniently processed; moreover, a strong adhesive is coated on the release paper on the other side of the double-sided adhesive tape to form a strong adhesive layer, and the end portion of a previous packaging section is folded into a Z-shaped folded end, thus allowing the double-sided adhesive tape to be located on an end surface of the recession of the folded end close to the middle portion of the adhesive area, and allowing the strong adhesive layer to be bonded to the other end surface of the recession of the folded end close to the middle portion of the adhesive area; at this point, compared with directly coating a strong adhesive on the adhesive area to form strong adhesive layer, the situation that the overlapped portion of the adhesive area is bonded by the strong adhesive layer when folding the end portion of a previous packaging section due to the problem that the detachable layer is not aligned with the strong adhesive layer can be avoided.

In another aspect of the present invention, step S1 specifically comprises the steps of: coating an adhesive layer on the roll film base material, thereby forming adhesive areas at intervals on the same side of the roll film base material; forming non-adhesive areas between every two adjacent adhesive areas, wherein each adhesive area and an adjacent non-adhesive area form a packaging section; in step S4, a tearing line is formed at the junction of the non-adhesive area of a later packaging section and the adhesive area of a previous packaging section.

In another aspect of the present invention, step S1 specifically comprises the steps of: bonding an adhesive area formed by an adhesive film to a non-adhesive area formed by a non-adhesive film through an adhesive tape, thereby forming a packaging section, and then bonding the adhesive area of a previous packaging section to the non-adhesive area of a later packaging section through an adhesive tape, thereby forming a roll film base material; in step S4, a tearing line is formed at the end portion of the non-adhesive area of a later packaging section close to the adhesive area of a previous packaging section.

BRIEF DESCRIPTION OF THE DRAWINGS

(FIGS. 4 and 5 are two principle diagrams for illustrating the separation of two packaging sections);

MARKING INSTRUCTIONS OF THE DRAWINGS

1—Packaging Section, 11—Adhesive Area, 111—Folded end, 12—Non-adhesive Area, 2—Detachable Bonding Structure, 21—Strong Adhesive Layer, 22—Detachable Layer, 23—Adhesive Layer, 3—Tearing Line, 4—Adhesive Tape

DETAILED DESCRIPTION OF THE INVENTION

Drawings and detailed embodiments are combined hereinafter to elaborate the technical principles of the present invention.

Figure 1:
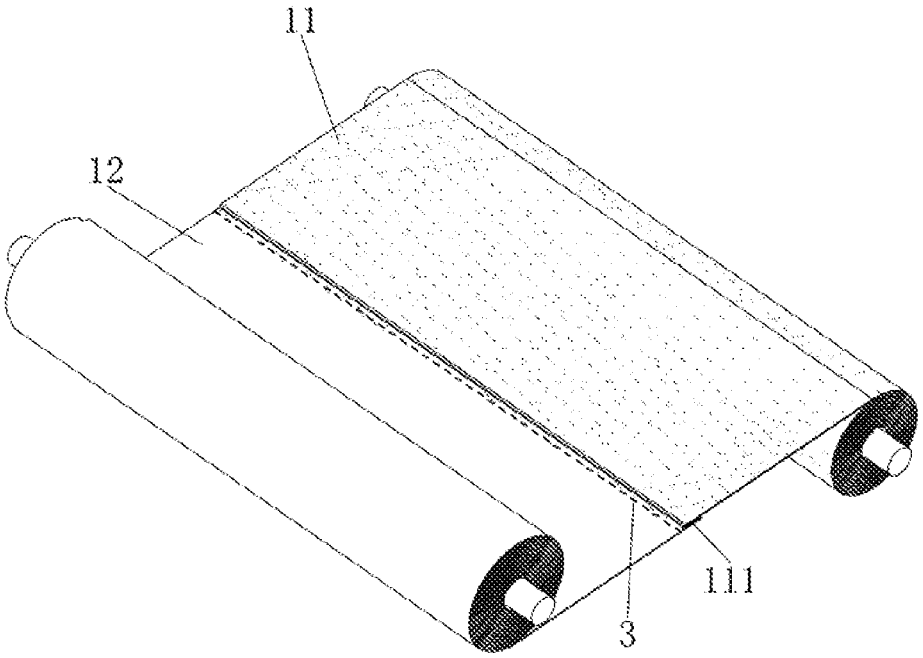
FIG. 1 is a structural diagram of embodiment 1 (merely for illustrating the connection portion between two adjacent packaging sections)
Figure 2:
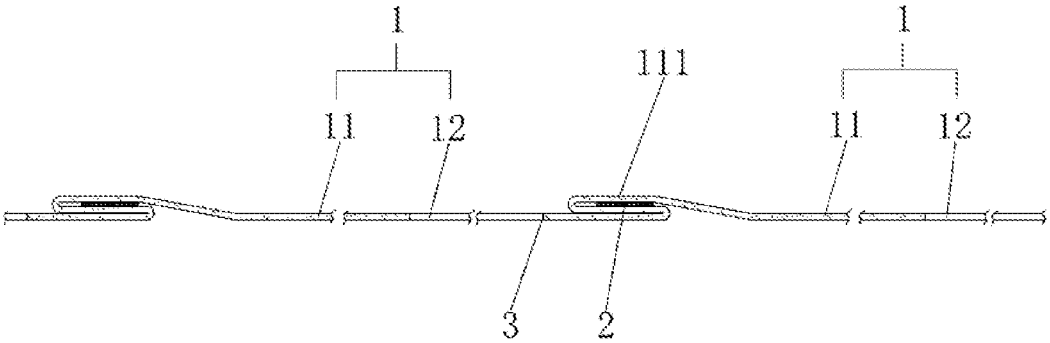
FIG. 2 is a schematic diagram illustrating the connection between the adjacent packaging sections of embodiment 1.

Embodiment 1: a cotton packaging roll film, as shown in FIGS. 1-2, comprises a roll film base material formed by a plurality of packaging sections 1 that are connected end to end. The packaging section 1 comprises an adhesive area 11 and a non-adhesive area 12 connected with the adhesive area 11. A plurality of packaging sections 1 are integrally arranged, and the adhesive area 11 and the non-adhesive area 12 of the packaging section 1 are integrally arranged.

Figure 3:
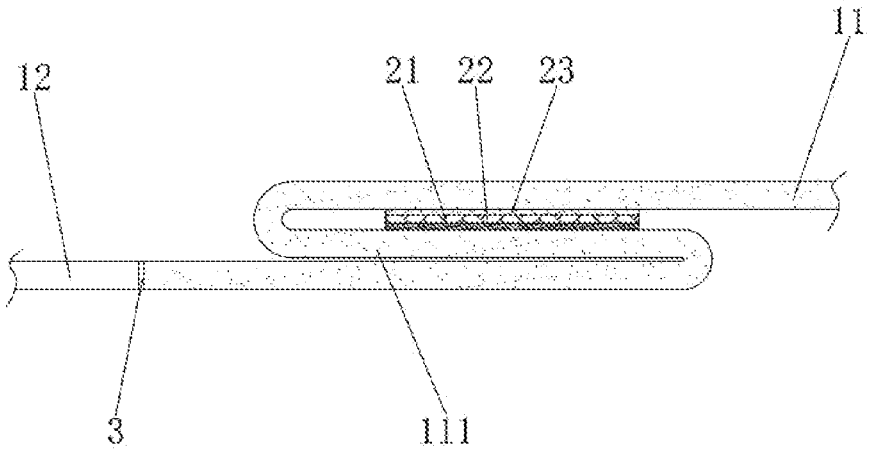
FIG. 3 is a schematic diagram for illustrating a partial structure of the detachable bonding structure of embodiment 1.
Figure 4:
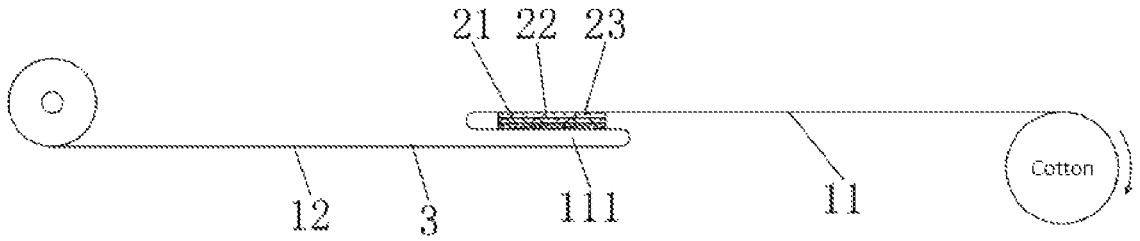
FIGS. 4, 5, 6 and 7 are schematic diagrams for illustrating the packaging process of embodiment 1
Figure 5:
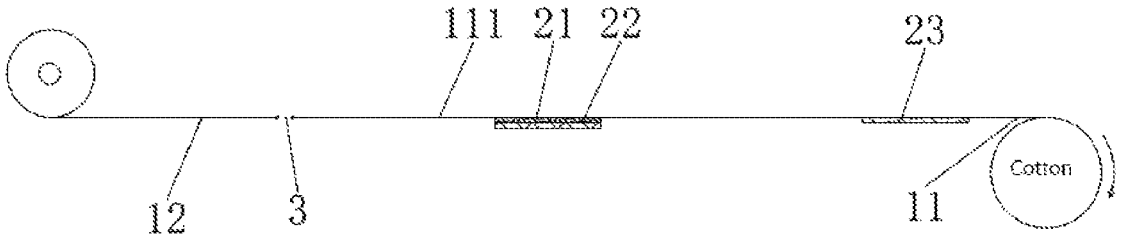
Figure 6:
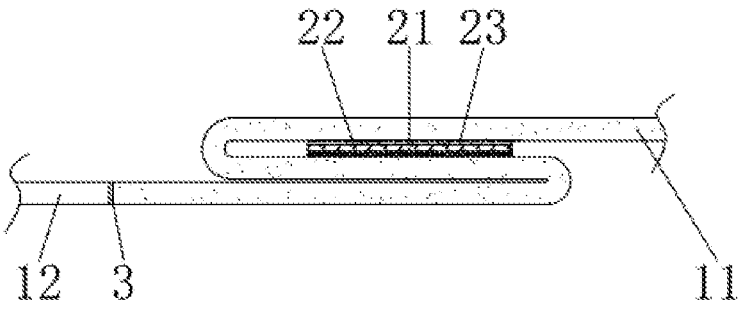
Figure 7:
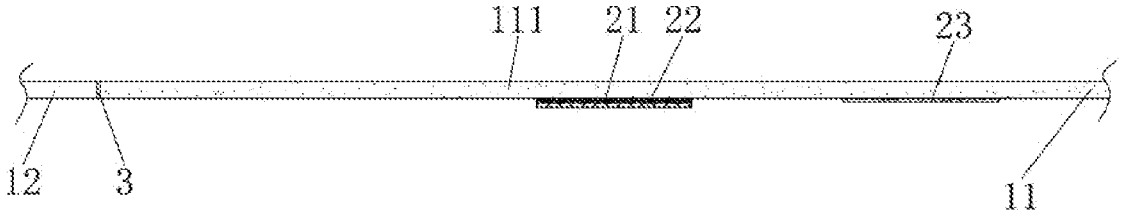

As shown in FIGS. 2-3, the adhesive area 11 of a previous packaging section 1 is connected to one end of the non-adhesive area 12 of a later packaging section 1, wherein the said end of the non-adhesive area 12 is a Z-shaped folded end 111. A detachable bonding structure 2 is arranged between the two end surfaces of the recession of the folded end 111 close to the middle portion of the adhesive area 11. The detachable bonding structure 2 comprises a strong adhesive layer 21, a detachable layer 22 and an adhesive layer 23. On the two end surfaces of the recession of the folded end 111 close to the middle portion of the adhesive area 11, the adhesive layer 23 is located on the end surface close to the middle portion of the adhesive area 11, and the strong adhesive layer 21 is located on the end surface far away from the middle portion of the adhesive layer. The detachable layer 22 is located between the strong adhesive layer 21 and the adhesive layer 23, and the detachable layer 22 can be detached from the adhesive layer 23. There's only one detachable bonding structure 2, and the detachable bonding structure 2 extends along the width direction of the adhesive area 11.

As shown in FIGS. 1-3, a tearing line 3 used for separation during packaging is arranged at the junction of the adhesive area 11 of a previous packaging section 1 and the non-adhesive area 12 of a later packaging section 1. The tearing line 3 is located at the junction of the non-adhesive area 12 of a later packaging section 1 and the adhesive area 11 of a previous packaging section 1. The tearing line 3 extends along the width direction of the roll film base material, and the tearing line 3 is a broken line provided with easy-to-tear holes.

The implementation principle is as follows: with reference to FIGS. 2-7, the detachable bonding structure 2 comprises a strong adhesive layer 21, a detachable layer 22 and an adhesive layer 23. When the roll film is wound on a rolling drum, the detachable layer 22 covers the adhesive layer 23, thereby preventing different layers of the roll film wound on the rolling drum from being bonded together. However, when the roll film is unrolled for packaging the cotton, the detachable layer 22 can be peeled off and completed detached from the adhesive layer 23 at the end of a cycle of the packaging section 1. The adhesive layer 23 is used for being bonded to the adhesive area 11 of the next layer for sealing at the end of the cycle of the packaging section 1. When the cycle of the packaging section 1 is ended, the rolling drum stops, and the wrapped cotton can tear the tearing line 3 due to the tension force generated by rotating inertia, thereby separating the packaging sections 1 during packaging. When the roll film body is torn along the tearing line 3, the portions of the roll film body at the two ends of the tearing line 3 deform under the action of the tension force. Due to the arrangement of the folded end 111 of the adhesive area 11, a certain distance exists between the adhesive layer 23 and the end edge of the adhesive area 11, thus preventing the adhesive area 11 on the adhesive layer from easily deforming. In this way, the adhesive layer 23 is kept flat, and the bonding effect of the adhesive layer 23 isn't affected.

Figure 8:
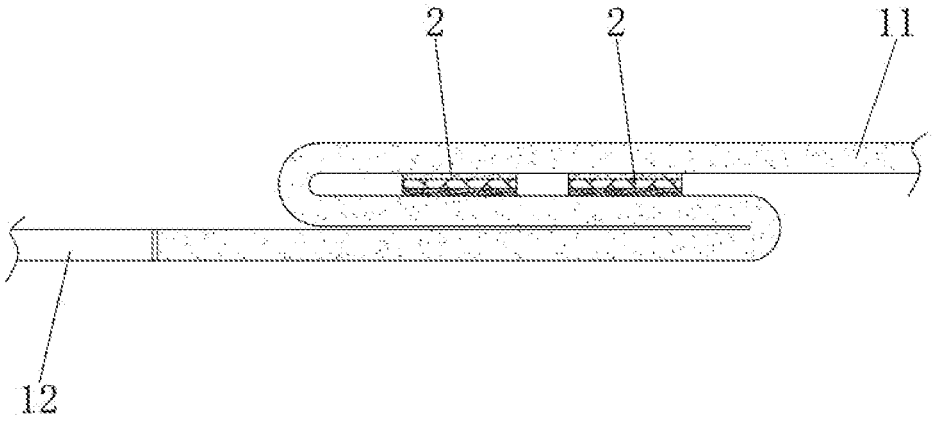
FIG. 8 is a schematic diagram for illustrating a partial structure of the detachable bonding structure of embodiment 2.

Embodiment 2: a cotton packaging roll film, as shown in FIG. 8, has following features differing from that of embodiment 1: a plurality of detachable bonding structures 2 are arranged in this embodiment, wherein each detachable bonding structure 2 extends along the width direction of the roll film base material, and the plurality of detachable bonding structures 2 are distributed in the length direction of the roll film base material.

Figure 9:
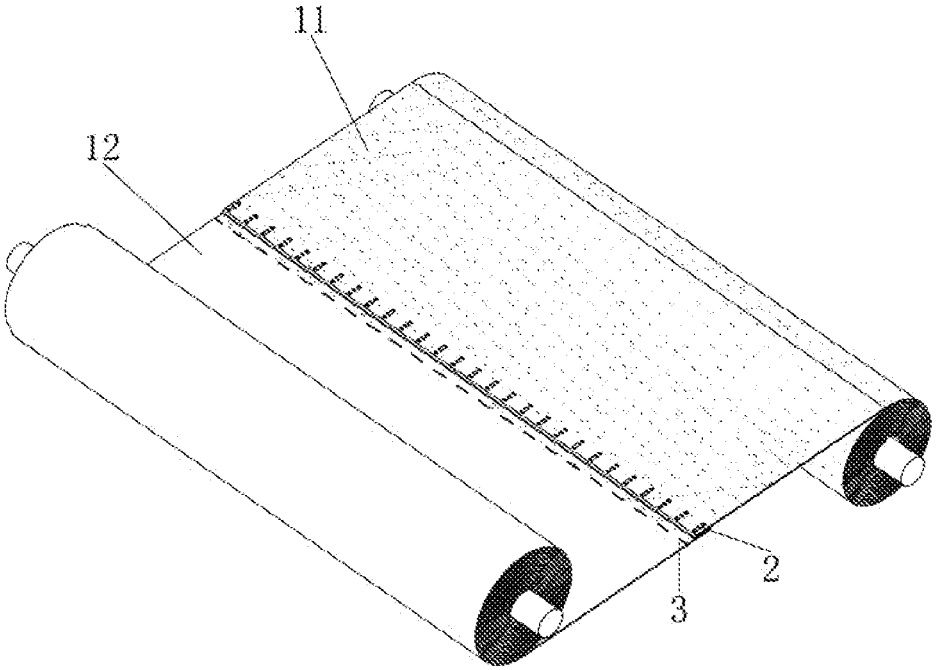
FIG. 9 is a structural diagram of embodiment 3.

Embodiment 3: a cotton packaging roll film, as shown in FIG. 9, has following features differing from that of embodiment 1: a plurality of detachable bonding structures 2 are arranged in this embodiment, wherein each detachable bonding structure 2 extends along the length direction of the roll film base material, and the plurality of detachable bonding structures 2 are distributed in the width direction of the roll film base material.

Figure 10:
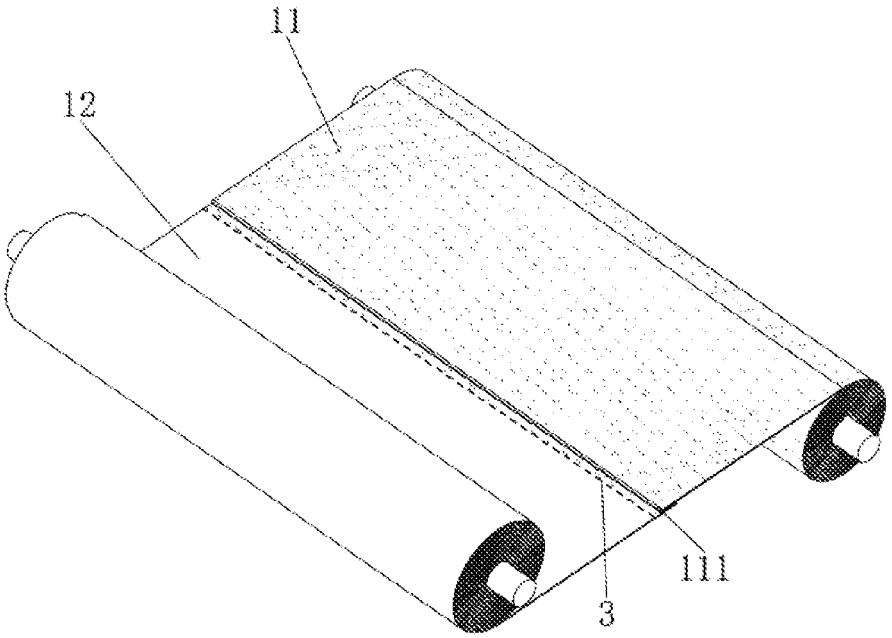
FIG. 10 is a structural diagram of embodiment 4.
Figure 11:
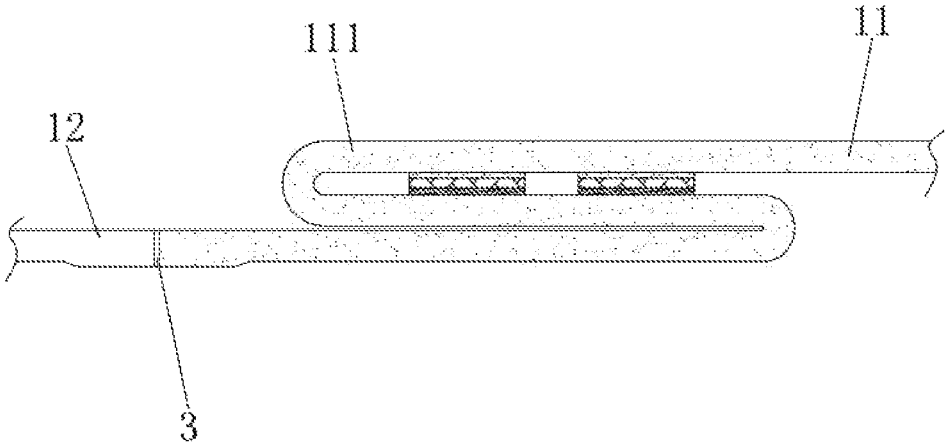
FIG. 11 is a schematic diagram for illustrating a partial structure of the detachable bonding structure of embodiment 4.

Embodiment 4: a cotton packaging roll film, as shown in FIGS. 10-11, has following features differing from that of embodiment 2: the tearing line 3 is obliquely arranged, and the included angle formed between the tearing line 3 and the width direction of the roll film base material is 2 degrees; meanwhile, the thickness of the portion of the adhesive area 11 close to the tearing line 3 is greater than that of the rest of the adhesive area 11, and the thickness of the portion of the non-adhesive area 12 close to the tearing line 3 is greater than that of the rest of the non-adhesive area 12 (the end portion of the folded end 111).

Figure 12:
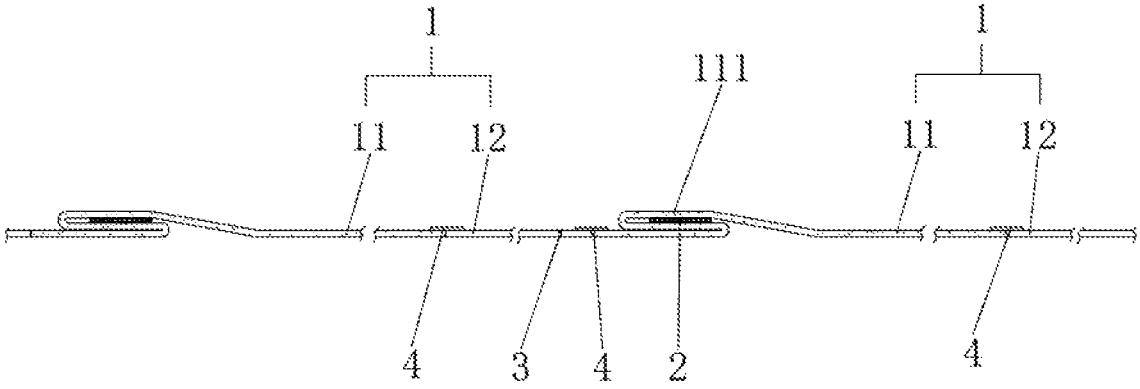
FIG. 12 is a schematic diagram illustrating the connection between the adjacent packaging sections of embodiment 5.

Embodiment 5: a cotton packaging roll film, as shown in FIG. 12, comprises a roll film base material formed by a plurality of packaging sections 1 that are connected end to end; the packaging section 1 comprises an adhesive area 11 and a non-adhesive area 12 connected with the adhesive area 11; the adhesive area 11 and the non-adhesive area 12 of the adjacent packaging sections 1 are bonded through an adhesive tape 4, and the adhesive area 11 and the non-adhesive area 12 of the packaging section 1 are bonded through an adhesive tape 4.

As shown in FIG. 12, the adhesive area 11 of a previous packaging section 1 is connected to one end of the non-adhesive area 12 of a later packaging section 1, wherein the said end of the non-adhesive area 12 is a Z-shaped folded end 111. A detachable bonding structure 2 is arranged between the two end surfaces of the recession of the folded end 111 close to the middle portion of the adhesive area 11. The detachable bonding structure 2 of this embodiment is the same as that of embodiment 1.

As shown in FIG. 12, a tearing line 3 used for separation during packaging is arranged at the junction of the adhesive area 11 of a previous packaging section 1 and the non-adhesive area 12 of a later packaging section 1. The tearing line 3 is located at the end portion of the non-adhesive area 12 of a later packaging section 1 close to the adhesive area 11 of a previous packaging section 1. After the tearing line 3 is torn apart, the portion of the non-adhesive area 12 of a later packaging section 1 that is located between the end portion and the tearing line 3 is connected with the adhesive area 11 of a previous packaging section 1. The tearing line 3 extends along the width direction of the roll film base material, and the tearing line 3 is a broken line provided with easy-to-tear holes.

Figure 13:
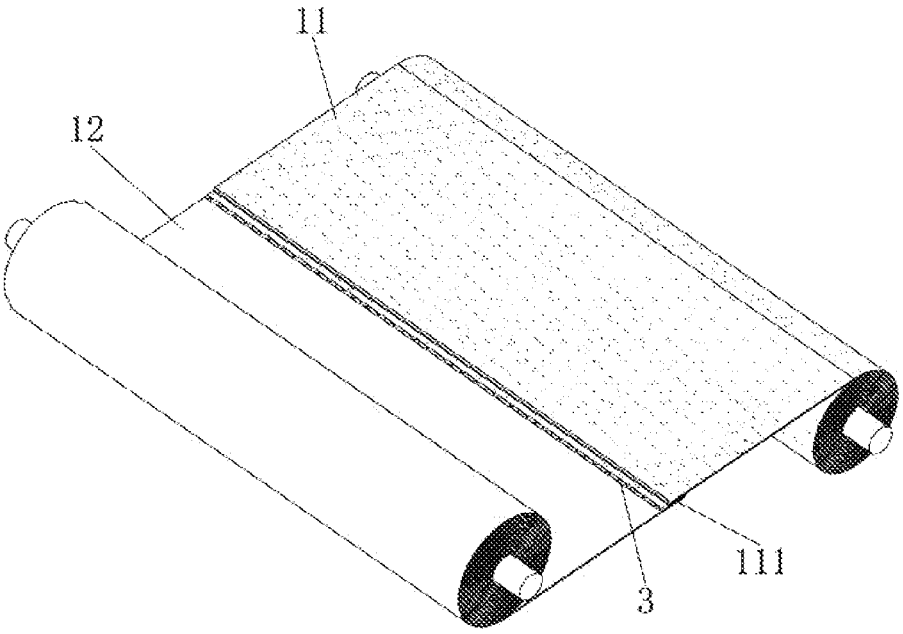
FIG. 13 is a structural diagram of embodiment 6.
Figure 14:
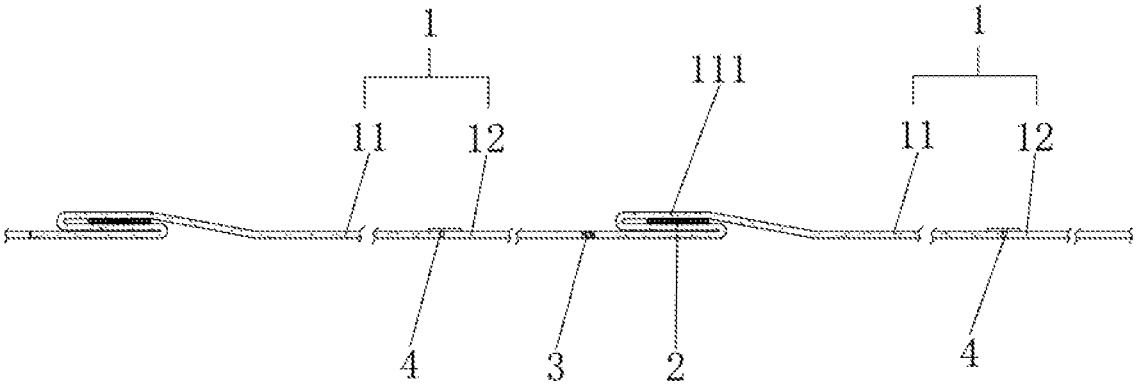
FIG. 14 is a schematic diagram illustrating the connection between the adjacent packaging sections of embodiment 6.

Embodiment 6: a cotton packaging roll film, as shown in FIGS. 13-14, comprises a roll film base material formed by a plurality of packaging sections 1 that are connected end to end; the packaging section 1 comprises an adhesive area 11 and a non-adhesive area 12 connected with the adhesive area 11; the adhesive area 11 and the non-adhesive area 12 of the packaging section 1 are bonded through an adhesive tape 4.

As shown in FIGS. 13-14, the adhesive area 11 of a previous packaging section 1 is connected to one end of the non-adhesive area 12 of a later packaging section 1, wherein the said end of the non-adhesive area 12 is a Z-shaped folded end 111. A detachable bonding structure 2 is arranged between the two end surfaces of the recession of the folded end 111 close to the middle portion of the adhesive area 11. The detachable bonding structure 2 of this embodiment is the same as that of embodiment 1.

As shown in FIGS. 13-14, a tearing line 3 used for separation during packaging is arranged at the junction of the adhesive area 11 of a previous packaging section 1 and the non-adhesive area 12 of a later packaging section 1. The tearing line 3 is a hot-melt joint formed by hot-melt connection at the junction of the adhesive area 11 of a previous packaging section 1 and the non-adhesive area 12 of a later packaging section 1.

Figure 15:
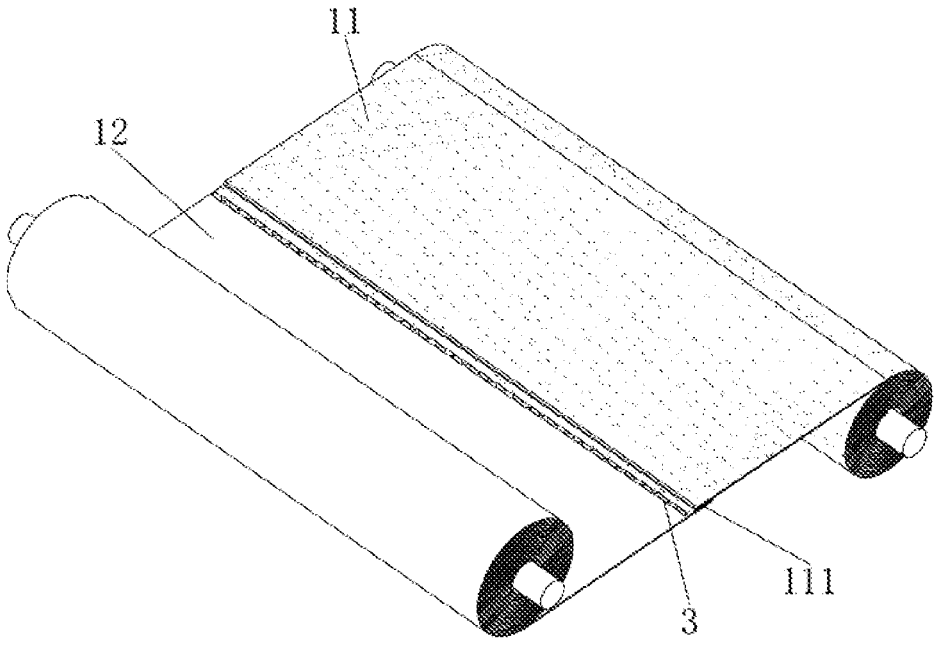
FIG. 15 is a structural diagram of embodiment 7.
Figure 16:
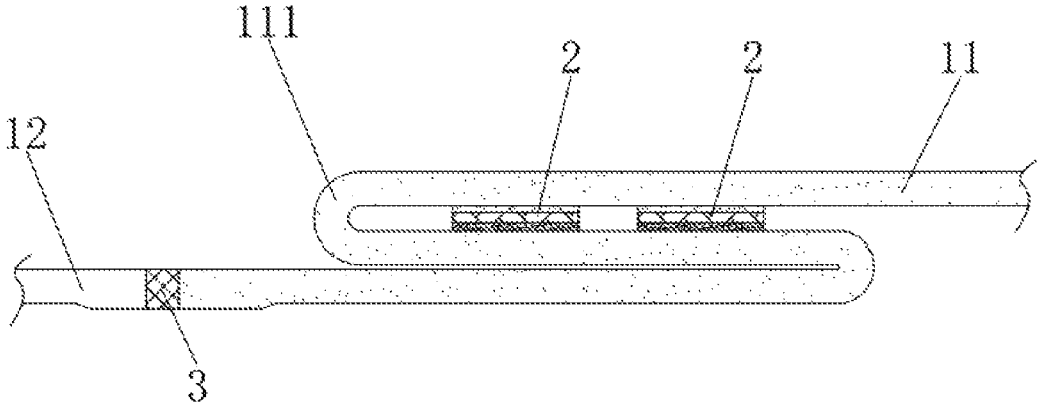
FIG. 16 is a schematic diagram for illustrating a partial structure of the detachable bonding structure of embodiment 7.

Embodiment 7: a cotton packaging roll film, as shown in FIGS. 15-16, has following features differing from that of embodiment 6: the tearing line 3 is obliquely arranged, and the included angle formed between the tearing line 3 and the width direction of the roll film base material is 5 degrees; meanwhile, the thickness of the portion of the adhesive area 11 close to the tearing line 3 is greater than that of the rest of the adhesive area 11, and the thickness of the portion of the non-adhesive area 12 close to the tearing line 3 is greater than that of the rest of the non-adhesive area 12. A plurality of detachable bonding structures 2 are arranged in this embodiment, wherein each detachable bonding structure 2 extends along the width direction of the roll film base material, and the plurality of detachable bonding structures 2 are distributed in the length direction of the roll film base material.

Embodiment 8: a method for preparing the cotton packaging roll film of embodiment 1, comprising the steps of:

S1: preparing a roll film base material: coating an adhesive layer on the roll film base material, thereby forming adhesive areas 11 at intervals on the same side of the roll film base material; forming non-adhesive areas 12 between every two adjacent adhesive areas 11, wherein each adhesive area 11 and an adjacent non-adhesive area 12 form a packaging section 1;

S2: tearing off the release paper on one side of a double-sided adhesive tape, and bonding one end of the adhesive area 11 of a previous packaging section 1 close to the adhesive area 11 of a later packaging section 1 with the double-sided adhesive tape; coating a strong adhesive on the release paper on the other side of the double-sided adhesive tape, thereby forming a strong adhesive layer 21, wherein the adhesive on the double-sided adhesive tape forms an adhesive layer 23, and the release paper on the other side of the double-sided adhesive tape forms a detachable layer 22;

S3: folding the end portion of a previous packaging section 1 to form a Z-shaped folded end 111, thereby allowing the double-sided adhesive tape to be located on an end surface of the recession of the folded end 111 close to the middle portion of the adhesive area 11, and allowing the strong adhesive layer 21 to be bonded to the other end surface of the recession of the folded end 111 close to the middle portion of the adhesive area 11;

S4: forming a tearing line 3 at the junction of the adhesive area 11 of a previous packaging section 1 and the non-adhesive area 12 of a later packaging section 1, wherein the tearing line 3 is a broken line with easy-to-tear holes that are machined at the junction of the adhesive area 11 of a previous packaging section 1 and the non-adhesive area 12 of a later packaging section 1 through a laser drilling machine.

Implementation effect: through the arrangement of the double-sided adhesive tape, a detachable layer 22 and an adhesive layer 21 are formed; the raw material double-sided adhesive tapes can be directly purchased and conveniently processed; moreover, a strong adhesive is coated on the other side of the double-sided adhesive tape to form a strong adhesive layer 21, and the end portion of a previous packaging section is folded into a Z-shaped folded end 111, thus allowing the double-sided adhesive tape to be located on an end surface of the recession of the folded end 111 close to the middle portion of the adhesive area 11, and allowing the strong adhesive layer 21 to be bonded to the other end surface of the recession of the folded end 111 close to the middle portion of the adhesive area 11; at this point, compared with directly coating a strong adhesive on the adhesive area 11 to form strong adhesive layer 21, the situation that the overlapped portion of the adhesive area 11 is bonded by the strong adhesive layer 21 when folding the end portion of a previous packaging section 1 due to the problem that the detachable layer is not aligned with the strong adhesive layer 21 can be avoided.

Embodiment 9: a method for preparing a plastic film of embodiment 5, comprising the steps of:

S1: bonding an adhesive area 11 formed by an adhesive film to a non-adhesive area 12 formed by a non-adhesive film through an adhesive tape 4, thereby forming a packaging section 1, and then bonding the adhesive area 11 of a previous packaging section 1 to the non-adhesive area 12 of a later packaging section 1 through an adhesive tape, thereby forming a roll film base material;

S2: tearing off the release paper on one side of a double-sided adhesive tape, and bonding one end of the adhesive area 11 of a previous packaging section 1 close to the adhesive area 11 of a later packaging section 1 with the double-sided adhesive tape; coating a strong adhesive on the release paper on the other side of the double-sided adhesive tape, thereby forming a strong adhesive layer 21, wherein the adhesive on the double-sided adhesive tape forms an adhesive layer 23, and the release paper on the other side of the double-sided adhesive tape forms a detachable layer 22;

S3: folding the end portion of a previous packaging section 1 to form a Z-shaped folded end 111, thereby allowing the double-sided adhesive tape to be located on an end surface of the recession of the folded end 111 close to the middle portion of the adhesive area 11, and allowing the strong adhesive layer 21 to be bonded to the other end surface of the recession of the folded end 111 close to the middle portion of the adhesive area 11;

S4: forming a tearing line 3 at the end portion of the non-adhesive area 12 of a later packaging section 1 close to the adhesive area 11 of a previous packaging section 1, wherein the tearing line 3 is a hot-melt joint formed by connecting two packaging sections 1 through a hot-melting equipment.

The above embodiments are merely an explanation of the present invention and are not intended to limit the present invention. After reading the specification, those skilled in the art can make modifications according to needs without paying creative labor. What falls into the scope of the claims of the present invention is protected by the Patent Law.

The invention claimed is:

1. A cotton packaging roll film, comprising:

a roll film base material formed by a plurality of packaging sections (1) that are connected end to end, wherein the packaging section (1) comprises an adhesive area (11) and a non-adhesive area (12) connected with the adhesive area (11), wherein the adhesive area (11) of a previous packaging section (1) is connected to one end of the non-adhesive area (12) of a later packaging section (1), wherein the said end of the non-adhesive area (12) is a Z-shaped folded end (111), wherein a detachable bonding structure (2) is arranged between the two end surfaces of the recession of the folded end (111) close to the middle portion of the adhesive area (11), wherein the detachable bonding structure (2) comprises a first adhesive layer (21), a detachable layer (22) and a second adhesive layer (23), wherein the first adhesive layer and the second adhesive layer are respectively located on the two end surfaces of the recession of the folded end (111) close to the middle portion of the adhesive area (11), wherein the detachable layer is located between the first adhesive layer and the second adhesive layer, wherein a tearing line (3) used for separation during packaging is arranged at the junction of the adhesive area (11) of a previous packaging section (1) and the non-adhesive area (12) of a later packaging section (1).

2. The cotton packaging roll film of claim 1, wherein on the two end surfaces of the recession of the folded end (111) close to the middle portion of the adhesive area (11), the second adhesive layer (23) is located on the end surface close to the middle portion of the adhesive area (11).

3. The cotton packaging roll film of claim 1, wherein a plurality of detachable bonding structures (2) are arranged between the two end surfaces of the recession of the folded end (111) close to the middle portion of the adhesive area (11), and the plurality of detachable bonding structures (2) are distributed in the length direction or width direction of the roll film base material.

4. The cotton packaging roll film of claim 1, wherein the tearing line (3) is located at the end portion of the non-adhesive area (12) of a later packaging section (1) close to the adhesive area (11) of a previous packaging section (1), wherein after the tearing line (3) is torn apart during packaging, the portion of the non-adhesive area (12) of a later packaging section (1) that is located between the end portion and the tearing line (3) is connected with the adhesive area (11) of a previous packaging section (1).

5. The cotton packaging roll film of claim 1, wherein the tearing line (3) is located at the junction of the non-adhesive area (12) of a later packaging section (1) and the adhesive area (11) of a previous packaging section (1).

6. The cotton packaging roll film of claim 1, wherein the tearing line (3) is a broken line with easy-to-tear holes or a holt-melt joint.

7. The cotton packaging roll film of claim 1, wherein the tearing line (3) is obliquely arranged, and the included angle formed between the tearing line (3) and the width direction of the roll film base material is 1-5 degrees, wherein the portions of the roll film base material located on the two sides of the tearing line (3) have a thickness greater than that of the other portions of the roll film base material.

8. A method for preparing the cotton packaging roll film of claim 1, comprising the steps of:

S1: preparing a roll film base material: forming a plurality of adhesive areas (11) and non-adhesive areas (12) that are arranged at intervals on the roll film base material, wherein each adhesive area (11) and an adjacent non-adhesive area (12) form a packaging section (1);

S2: tearing off the release paper on one side of a double-sided adhesive tape, and bonding one end of the adhesive area (11) of a previous packaging section (1) close to the adhesive area (11) of a later packaging section (1) with the double-sided adhesive tape, and coating a adhesive on the release paper on the other side of the double-sided adhesive tape, thereby forming a first adhesive layer (21), wherein the adhesive on the double-sided adhesive tape forms a second adhesive layer (23), and the release paper on the other side of the double-sided adhesive tape forms a detachable layer (22);

S3: folding the end portion of a previous packaging section (1) to form a Z-shaped folded end (111), thereby allowing the double-sided adhesive tape to be located on an end surface of the recession of the folded end (111) close to the middle portion of the adhesive area (11), and allowing the first adhesive layer (21) to be bonded to the other end surface of the recession of the folded end (111) close to the middle portion of the adhesive area (11);

S4: forming a tearing line (3) at the junction of the adhesive area (11) of a previous packaging section (1) and the non-adhesive area (12) of a later packaging section (1).

9. The method for preparing the cotton packaging roll film of claim 8, wherein step S1 specifically comprises the steps of: coating a third adhesive layer on the roll film base material, thereby forming adhesive areas (11) at intervals on the same side of the roll film base material, and forming non-adhesive areas (12) between every two adjacent adhesive areas (11), wherein each adhesive area (11) and an adjacent non-adhesive area (12) form a packaging section (1), wherein in step S4, a tearing line (3) is formed at the junction of the non-adhesive area (12) of a later packaging section (1) and the adhesive area (11) of a previous packaging section (1).

10. The method for preparing the cotton packaging roll film of claim 8, wherein step S1 specifically comprises the steps of: bonding an adhesive area (11) formed by an adhesive film to a non-adhesive area (12) formed by a non-adhesive film through an adhesive tape (4), thereby forming a packaging section (1), and then bonding the adhesive area (11) of a previous packaging section (1) to the non-adhesive area (12) of a later packaging section (1) through an adhesive tape (4), thereby forming a roll film base material, wherein in step S4, a tearing line (3) is formed at the end portion of the non-adhesive area (12) of a later packaging section (1) close to the adhesive area (11) of a previous packaging section (1).

* * * * *